United States Patent [19]

Smith et al.

[11] 4,089,637

[45] May 16, 1978

[54] CONTROL OF AIR FLOW IN A BURNER FOR A TANGENTIALLY FIRED BOILER

[75] Inventors: Donald Arthur Smith, Haddam, Conn.; David Joseph Horan, Westfield, Mass.

[73] Assignee: Combustion Engineering, Inc., Windsor, Conn.

[21] Appl. No.: 798,967

[22] Filed: May 20, 1977

[51] Int. Cl.[2] ..... F23M 9/08; F23C 5/18

[52] U.S. Cl. ..... 431/183; 431/173; 431/175; 239/406

[58] Field of Search ..... 431/175, 183, 184, 351, 431/173; 110/28 B; 239/403, 405, 406

[56] References Cited

U.S. PATENT DOCUMENTS

| | | | |
|---|---|---|---|
| 1,665,800 | 4/1928 | Strachan et al. | 239/405 |
| 1,910,735 | 5/1933 | Zikesch | 110/28 B |
| 2,883,948 | 4/1959 | Seidl | 431/173 |
| 3,723,049 | 3/1973 | Juricek | 431/183 |

*Primary Examiner*—Carroll B. Dority, Jr.
*Attorney, Agent, or Firm*—Wayne H. Lang

[57] ABSTRACT

A fuel admission assembly for a tangentially fired furnace that utilizes oil, gas, or other utility grade fuels. The assembly disclosed has the ability to achieve a positive control of the air flow through a specially designed swirler. Because of this unique feature of its design, this assembly will permit efficient tangential boiler operation at 5% excess air or less over a fuel turndown ratio of at least 3 to 1 on each assembly. At the same time, it will not produce unacceptable levels of noxious emissions such as oxides of nitrogen, carbonaceous soot or sulfur smuts over its full operating range. Finally, it requires no additional fan head (windbox pressure drop).

7 Claims, 3 Drawing Figures

CONTROL OF AIR FLOW IN A BURNER FOR A TANGENTIALLY FIRED BOILER

BACKGROUND OF THE INVENTION

The present invention relates to gas or oil burning arrangements, and particulary, it relates to a fuel admission assembly hereafter called an FAA having a central swirler for use in a tangentially fired furnace.

In modern heat generating apparatus utilizing oil or gas as a fuel, the load operating range over which an FAA must function efficiently is quite large. In order to maximize combustion efficiency and minimze soot formation, prior art furnaces of the tangential type normally operate at excess air levels of 10% to 20% at full furnace capacity and at even higher excess air levels (plus 50%) at reduced furnace load. With increased cost and reduced availability of high energy fuels such as gas and oil, there exists a need to improve boiler efficiency without increasing the production of noxious emissions. There also exists a need to improve low load boiler efficiency in units which use these expensive fuels as swing load units. One way to improve boiler efficiency is to reduce the level of excess air required to insure efficient combustion of the fuel. Inasmuch as efficient operation of an FAA throughout a wide load range is primarily dependent upon the thoroughness with which combustion air is mixed together with the fuel under all conditions of load, a rotational mode is imparted to the air in the FAA or in the furnace itself to enhance the mixing of the air and the fuel. To reduce the required amount of excess air needed to efficiently consume all of the fuel supplied to the furnace, the mixing generated by swirling the air must be increased in proportion to the desired reduction in excess air. Therefore, in a typical tangential furnace only a minor increase in fuel air mixing (swirl) is required at high load conditions where the tangential action is relatively strong but a significant increase is required at low load conditions where little, if any, tangential interaction exists.

At high loads, where maximum flow is experienced, tangential action within the furnace is dominant and it is sufficient to provide optimum mixing of the fuel and air, therefore the proportion of air directed through the swirler of an FAA may be reduced to a minimum. At low loads, however, there is little air flow within the furnace, and a greater portion of the combustion air must be supplied through the swirler of the FAA to compensate for reduced mixing within the furnace.

Finally, it is important that excessively rapid mixing (swirl) of fuel and air not be achieved because this can result in marked increases in oxides of nitrogen production. Therefore, a careful balance must be struck to insure enough mixing for efficient combustion at low excess air but not such intense mixing as to result in increased levels of oxides of nitrogen.

SUMMARY OF THE INVENTION

According to this invention, a unique tangentially fired windbox arrangement is combined with a typical tangential furnace to create a firing system which can be operated at 5% excess air or less over a fuel supply range of 3 to 1 on each FAA. Air is supplied to the windbox assembly in a typical fashion by means of a conduit between a fan and the windbox inlet. Depending on specific unit design, a regenerative air heater may also be inserted into this conduit without altering the invention. The concept is also equally applicable to balanced and induced draft furnace even though the means of air supply to the windbox may differ. According to this invention, there is provided a windbox and damper arrangement for a tangentially fired furnace. The unit provides a positive control over the distribution of combustion air flowing through a central swirler, an annulus of unswirled air, and auxiliary air nozzles throughout a wide variation of loading conditions. The control is provided by means of a damper arrangement and partition plates within the windbox that direct the air through the four air discharge points (swirler, annulus and two auxiliary air nozzles). The unit is adaptable to forced, induced or balanced draft methods of combustion air supply.

The standard operating sequence at low boiler loads for fuel inputs of less than one third of the maximum design fuel input, is to direct nearly all of the combustion air through a central conduit which supplies the air swirler providing the intense mixing of the air and fuel in the immediate region where the fuel and air streams are discharged into the furnace. Though not required in the preferred arrangement, the curvature of the flow swirl vanes may increase as one traverses radially inward toward the center of the swirler. This enhances the recirculation of hot combustion products from the furnace back toward the point of fuel injection. As fuel input is increased, air flow dampers which surround the central conduit that supplies the swirler air are gradually opened supplying air to an annulus of unswirled air. This annulus has two primary purposes. It supplies additional combustion air in a uniform fashion to the mixture of fuel and air created by the swirler which does not mix immediately but at some distance out in the furnace cavity thus promoting a high temperature fuel-rich region near the point of initial fuel injection. This condition of staged combustion is thought to be beneficial in attaining the relatively low levels of oxides of nitrogen produced by this design concept. The second purpose for this annulus of unswirled air is to control the shape of the flame produced by this windbox arrangement. As load is increased, if all of the combustion air is discharged through the swirler, the flame would assume the shape of a tulip and impinge severely on the walls of the furnace near the point of fuel and air injection. This would result in accelerated wastage of the furnace walls in this area. With the use of this annulus air, a long finger shaped flame is produced and as the furnace load is increased, these finger shaped flames interact to form a tangential vortex which completes the mixing of the annulus air with the swirler air/fuel mixture causing complete and efficient combustion. As fuel flow is increased further toward full load, two additional air compartments called auxiliary air nozzles located above and below the annulus conduit and having separate dampers begin to supply air to the furnace. This air is supplied at high velocities and does not completely mix with the annulus or swirler air until it reaches the center of the furnace where the mixing of the tangential vortex is controlling.

At this point, wherein optimum fuel/air mixing conditions within the furnace are obtained, vigorous streams of air and fuel are projected inward from each corner of the furnace along a line tangent to a small circle lying on a horizontal plane at the center of the furnace. Intensive mixing occurs where the streams of air meet and where turbulence is greatest. A rotative motion similar to that of a cyclone is imparted to the flame body sufficient to mix all the fuel and air for uniform and complete combustion.

In the preferred operating sequence, as fuel input is increased, the dampers for the swirler conduit are opened first to a point where a predetermined static pressure differential is maintained between a point just upstream of the windbox dampers and the furnace cavity. As fuel input is increased further to a point where further opening of the swirler dampers can no longer permit maintenance of this predetermined pressure differential, the annulus dampers begin to open to accomplish this end. In a similar fashion, when opening of the annulus dampers will no longer permit maintenance of this pressure differential, the auxiliary dampers begin to open to accomplish this end until full fuel input is reached. When particular furnace conditions or emissions limits dictate changes in the preferred method of damper operation, this arrangement need not necessarily be operated in the above described sequence and deviation from this, so long as the general sequence of opening is not deviated from, should not be considered a variation of the concept outlined here. In fact, in situations where extremely low levels of oxides of nitrogen must be achieved, it may be desirable at high fuel inputs where the tangential action of the furnace is predominant to reduce the flow of air to the swirler in favor of supplying more air to the annulus and auxiliary air conduits.

This invention is accordingly directed to a fuel admission assembly arrangement that is adapted to be used in conjunction with a tangentially fired furnace so as to provide optimum mixing of the combustion air and fuel at all load conditions. By this arrangement, there is disclosed a fuel admission assembly that provides maximum flame stability, effective combustion and a low rate of formation of harmful nitrous oxides at low load conditions as a supplement to the flame stability and efficient combustion that is normally present in a tangentially fired furnace at high load.

DESCRIPTION OF THE PREFERRED EMBODIMENT

Figure 1:
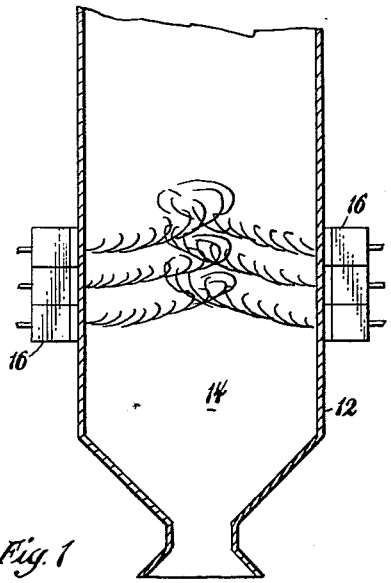
FIG. 1 is a schematic horizontal section of a tangentially fired furnace.
Figure 2:
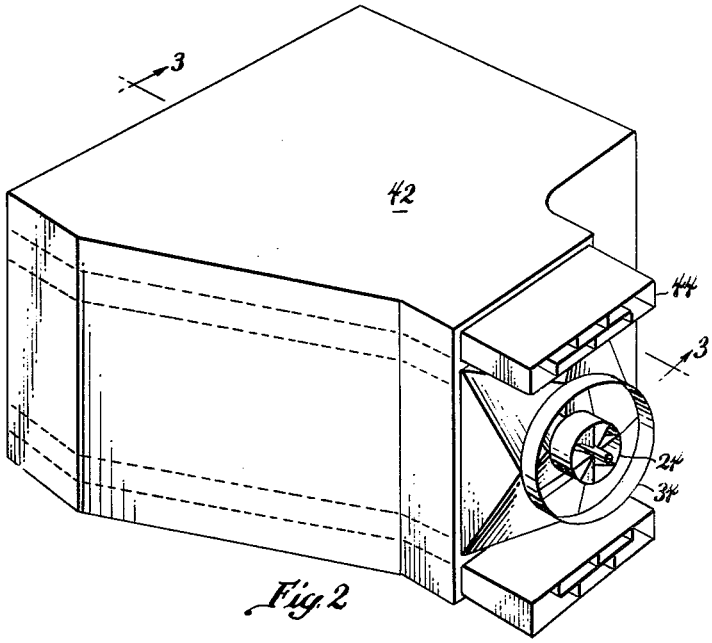
FIG. 2 is a perspective view of a burner according to the present invention.
Figure 3:
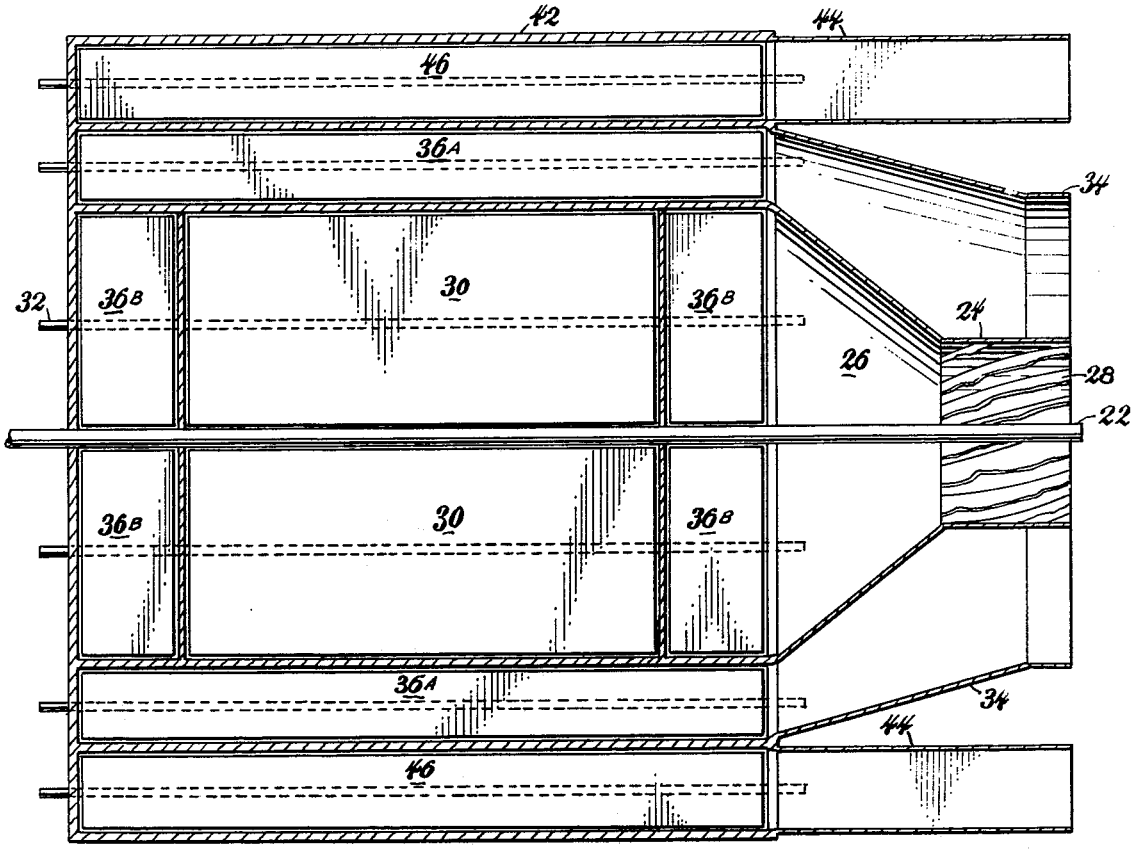
FIG. 3 is a view as seen from line 3—3 of FIG. 2.

Referring now to the drawings, there is shown a firewall that comprises the outer wall 12 at the corner of a furnace having a rectangular chamber 14 with burners 16 at each corner thereof arranged to exhaust a fuel and air mixture along a line tangent to a small circle lying in a horizontal plane at the center of the furnace chamber 14. One or more burners at each corner of the furnace are superposed one above the other to provide a firing rate with a predetermined thermal output that is capable of complete combustion of the gases within the chamber 14.

Air for combustion is supplied to each burner to insure the presence of sufficient oxygen for the complete combustion of the fuel. The fuel, such as oil, is supplied through gun 22 positioned centrally within the air supply ducts 24 whereby the exhaust end thereof projects into the furnace itself while the opposite end is connected to a fuel supply.

Located in the duct 24 concentrically surrounding the oil supply gun 22 are a plurality of vanes 28 that impart a rotary or swirling pattern to the air flowing therethrough whereby on emergence from the burner, fuel will be intimately mixed with the air. The air to duct 24 passes through a converging duct 26 that is modulated by a damper means 30 on shaft 32 controlled manually or in response to any one of various conditions according to normal burner practice.

Around the swirler air duct 24 is located a primary air duct 34 having an open end that constitutes a substantially annular opening around duct 26. The primary duct 34 is connected to a source of combustion air by means of a series of passageways that encircle the duct for the swirler air and serves as a nozzle that exhausts air into combustion chamber 14. Air flow through the ducts 34 that comprise the primary air duct is controlled at the top and bottom of the burner by independent dampers 36A and at the sides by dampers 36B which are controlled manually or in response to any one of various conditions, which demand changes in the primary air according to the boiler operating sequence.

At the periphery of each burner, the walls 42 are connected to ducts 44 to supply auxiliary air from a suitable source of supply to the combustion chamber 14 of the furnace. Air flow through supply ducts 44 is modulated by damper valves 46 which control the flow of auxiliary air into the combustion chamber to insure the complete combustion of fuel exhausting from supply gun 22.

At low loads, damper valves 46, 36A and 36B are closed entirely whereby all air exhausting from duct 24 of the burner is controlled by central dampers 30. As the air flows past vanes 28, it is imparted a rotary motion whereby it becomes thoroughly mixed with fuel exhausting from the tip of fuel gun 22, thus insuring greater flame stability at lower excess air. Thus, greater flame stability results in more efficient combustion of the fuel.

As the load increases, dampers 36A, 36B and 46 are progressively opened to thereby increase the total quantity of air flowing out of the burner and into the combustion chamber 14 through the primary and auxiliary air nozzles 34 and 44. The air flowing through peripheral nozzles 34 and 44 is not rapidly mixed with fuel when it is first exhausted into the furnace cavity. However, after it has traversed the turbulent vortex in the furnace cavity as created by the tangential placement of the burners, mixing of all air and fuel is complete and efficient combustion is assured.

The invention thereby provides a burner that cooperates with a tangentially fired furnace to provide optimum fuel/air mixing at all load conditions in a manner not possible with prior art devices. It will be apparent that other adaptations may be made without departing from the spirit and scope of the invention.

We claim:

1. A furnace having walls that enclose a central combustion chamber, a plurality of burners in said furnace each arranged to exhaust a fuel and air mixture long a line tangent to a small circle lying in a horizontal plane at the center of the combustion chamber, a source of fuel, nozzle means in the burner directing fuel from said source into the combustion chamber, a windbox associated with said burner including a source of combustion air, duct means connecting the windbox to the furnace, partition means dividing said duct into a plurality of independent passageways for a primary air stream, a secondary air stream, and a swirler air stream, vanes in the swirler air stream for imparting a rotary movement to air flowing therethrough, and valve means in the passageway for the swirler air stream modulating the flow of air therethrough.

2. The apparatus of claim 1 wherein the nozzle for the supply of fuel into the central combustion chamber lies adjacent the exhaust of the swirler air stream to permit the rotational mode of the swirler air stream to effect mixing of the fuel and swirler air.

3. The apparatus of claim 1 wherein the outlet for the swirler air stream comprises an annulus that concentrically surrounds the fuel nozzle to thus provide an intimate mixing of the swirler air stream and the fuel exhausting through the fuel nozzle.

4. The apparatus of claim 1 including valve means that modulate the air flowing through the passageways for the primary and secondary air to thereby control admission of unswirled air that surrounds the combustible air and fuel mixture projected by the swirler thereby providing an insulation barrier that separates mixed air and fuel from the walls of the furnace.

5. The apparatus of claim 1 including outlets ports for the primary and secondary air streams arranged to exhaust air from opposite sides of the swirler air stream to retard mixing of primary and secondary air with fuel thereby producing a pencil shaped flame that projects tangentially into said chamber.

6. The apparatus of claim 1 including an outlet port for the primary air stream arranged to exhaust from opposite sides of the swirler air stream to thus provide an envelope of unswirled air around the swirled air and fuel mixture that isolates the swirler air stream and fuel mixture from the walls of the furnace.

7. The apparatus of claim 6 having exhaust ports for the secondary air stream spaced from said swirler air stream to preclude mixing of the secondary air and the fuel in advance of the central portion of the combustion chamber of the furnace thereby retarding excessive mixing thereof and the formation of oxides of nitrogen.

* * * * *